US005278577A

United States Patent [19]

Kitsuki

[11] Patent Number: 5,278,577

[45] Date of Patent: Jan. 11, 1994

[54] METHOD OF CARRYING OUT A THERMAL TRANSFER PRINTING BY USING A THERMAL TRANSFER PRINTER

[75] Inventor: Kengo Kitsuki, Tokyo, Japan

[73] Assignee: Dai Nippon Insatsu Kabushiki Kaisha, Tokyo, Japan

[21] Appl. No.: 981,996

[22] Filed: Nov. 24, 1992

Related U.S. Application Data

[63] Continuation of Ser. No. 710,448, Jun. 5, 1991, abandoned, which is a continuation-in-part of Ser. No. 552,508, Jul. 16, 1990, Pat. No. 5,035,325.

[30] Foreign Application Priority Data

Jul. 18, 1989 [JP] Japan ..... 1-84178

[51] Int. Cl.[5] ..... B61J 2/32

[52] U.S. Cl. ..... 346/1.1; 346/76 PH; 400/120; 400/207; 400/208; 400/208.1

[58] Field of Search ..... 400/207, 208, 208.1, 400/120; 346/76 PH, 1.1

[56] References Cited

U.S. PATENT DOCUMENTS 4,569,608 2/1986 Watanabe ..... 400/208

FOREIGN PATENT DOCUMENTS 0049978 3/1985 Japan ..... 400/207 E
0115769 5/1988 Japan ..... 400/207 E
0224980 9/1988 Japan ..... 402/207 E

*Primary Examiner*—Benjamin R. Fuller
*Assistant Examiner*—Huan Tran
*Attorney, Agent, or Firm*—Wegner, Cantor, Mueller & Player

[57] ABSTRACT

A thermal transfer printing is carried out in a printer. A cassette case housing a thermal transfer printing film is inserted into the printer and set in position. The cassette case has an outer surface provided with a plurality of marking positions to one of which a reflective mark is applied to indicate the usage and/or ink characteristics of the printing film in the cassette case. For printing, printing sheets are fed into the printer. Each sheet has a sheet mark indicating the usage and/or ink characteristics adapted to it. The reflective mark and the sheet mark are detected in the printer, and only when it is determined that the detected marks are of the same usage and/or of the same ink characteristics, the printer is allowed to operate.

2 Claims, 2 Drawing Sheets

METHOD OF CARRYING OUT A THERMAL TRANSFER PRINTING BY USING A THERMAL TRANSFER PRINTER

CROSS-REFERENCES TO RELATED APPLICATIONS

This application is a continuation of U.S. application Ser. No. 07/710,448 filed Jun. 5, 1991, now abandoned, which is a continuation-in-part of Ser. No. 07/552,508 filed Jul. 16, 1990, U.S. Pat. No. 5,035,325.

BACKGROUND OF THE INVENTION

The present invention relates to a method of carrying-out a thermal transfer printing by using a thermal transfer printer.

Conventionally, cassettes for thermal transfer printing film have been used in order to facilitate the mounting of the thermal transfer printing film to the thermal transfer printer. On one and the other side of a cassette case for such thermal transfer printing film are a feed roller that feeds out the thermal transfer printing film and a take-up roller that winds up the thermal transfer printing film. When such a cassette is mounted to a printer, a drive mechanism of the printer is linked to the take-up roller, a portion of the film that extends from the feed roller to the take-up roller is brought into contact with the thermal head of the printer, the take-up roller is rotated by the drive mechanism and the thermal transfer printing film is drawn out of the feed roller so that it passes the thermal head where image recording is performed.

Usually there are different types of transfer conditions for the recording and of the uses of the sheets having thereon the image transferred by thermal transfer printing. Accordingly, a plural number of types of thermal transfer printing film are made available so as to correspond to these different conditions and uses. Because of this, there has been the problems of a cassette containing an unsuitable type of film being erroneously mounted to the printer, of the recording being performed under transfer conditions that are not appropriate for the film and sheets, and of a film and sheets suitable for another use being used.

SUMMARY OF THE INVENTION

In the light of these problems that exist with conventional thermal transfer printing, the object of the present invention is to provide a method of carrying out a thermal transfer printing by using a thermal transfer printer, wherein only when the usage and/or the ink characteristic of the thermal transfer printing film and the sheets are identical, the transfer printing is carried out in the printer.

In order to attain the above object, the method according to the present invention comprises the steps of: providing a cassette case housing a thermal transfer printing film and having an outer surface provided with a plurality of marking positions, applying to one of said positions a reflective mark to indicate a usage and/or an ink characteristic of said thermal transfer printing film, depending upon the position of the reflective mark, setting said cassette into said printer, feeding into said printer sheets each having a sheet mark indicating a usage and/or an ink characteristic thereof, detecting said reflective mark and said sheet mark, and operating said printer to transfer images on said thermal transfer printing film onto each of said sheets, only when the detected marks are of the same usage and/or the same ink characteristic.

An embodiment of the present invention will now be described in detail with reference to the accompanying drawings.

DESCRIPTION OF THE PREFERRED EMBODIMENT

Figure 1:
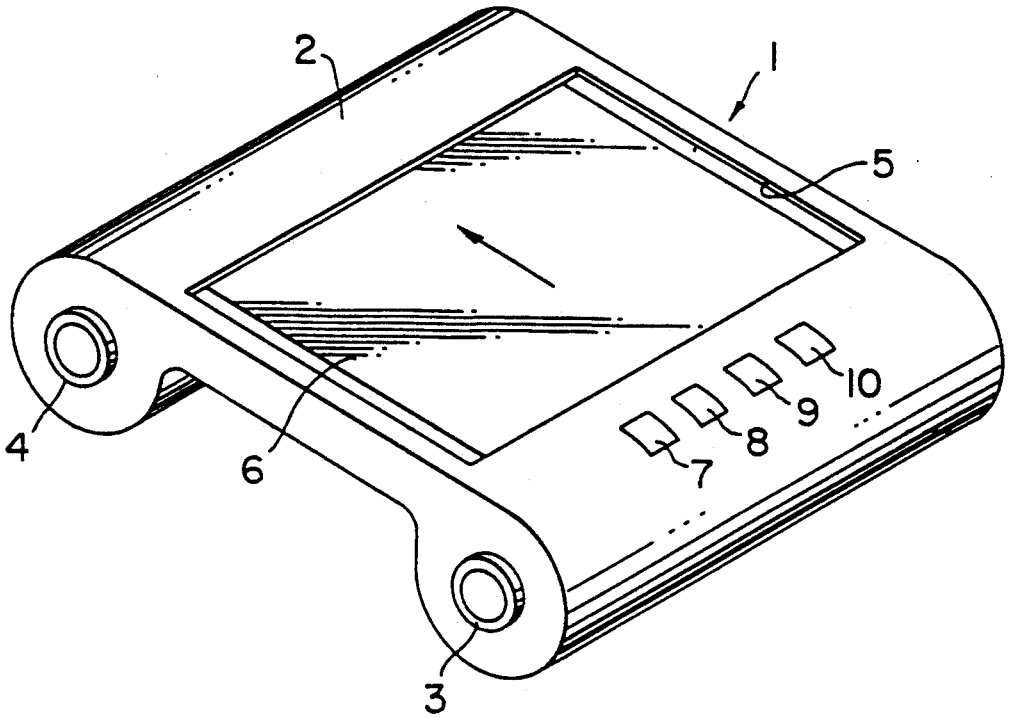
FIG. 1 is a perspective view indicating the entire configuration of a thermal transfer printing film cassette used in the method according to the present invention.

FIG. 1 shows a thermal transfer printing film cassette 1 used in the present invention The numeral 2 indicates a black-colored cassette case 2 made of polystyrene or ABS resin (acrylonitrile-butadiene-styrene resin). The case 2 houses in one side thereof a feed roll 3 for a thermal transfer printing film 6. The feed roll 3 is rotatable inside the cassette case 2. The case 2 houses in the other side thereof a rotatable take-up roll 4. There is a window 5 formed in the cassette case 2 between the two rolls 3 and 4. The leading end of the printing film 6 is drawn out from the feed roll 3 and taken up by the take-up roll 4.

Seals 7 through 10 of a PET film to which aluminum has been vapor deposited are affixed at appropriate positions on the outer surface of the cassette case 2. These positions indicates different types of usage and ink characteristics of the thermal transfer printing film 6. The positions at which the seals 7 through 10 are affixed are preferably on the outer surface of the casing part around the feed roll 3. The seals 7 through 10 may be arranged on a line parallel to the axis of the feed roll 3, as shown. The seals may be replaced by marks of any kind.

In the cassettes shown, the position 7 is provided with a reflective mark that indicates the ink characteristics. A high-density film is indicated if there is a seal affixed at this position, and a standard-density film is indicated if there is not a seal affixed at this position. Furthermore, reflective marks indicating the use are provided to the positions 8 through 10. For example, monochrom usage is indicated if there is a seal affixed at the position 8, and color usage is indicated if not. In addition, OHP (overhead projector) usage is indicated if there is a seal affixed at the position 9, and transfer to cloth is indicated if there is a seal affixed at the position 10. Combinations of positions of seals can also be used to indicate other modes.

Figure 3:
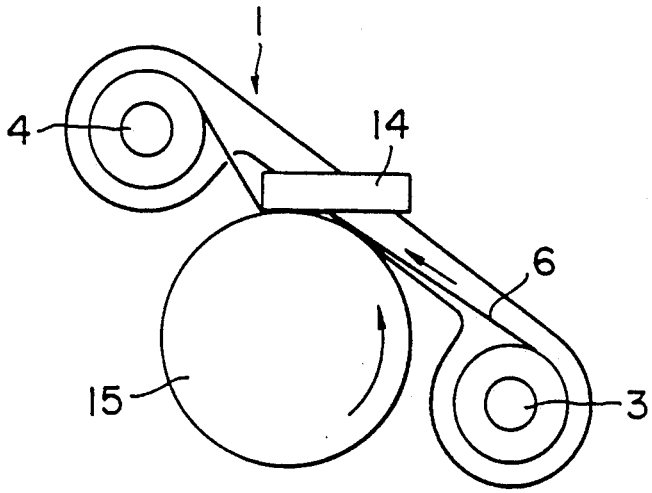
FIG. 3 is a side view showing the relationship of the film cassette, a thermal head of the printer and a platen roller.
Figure 2:
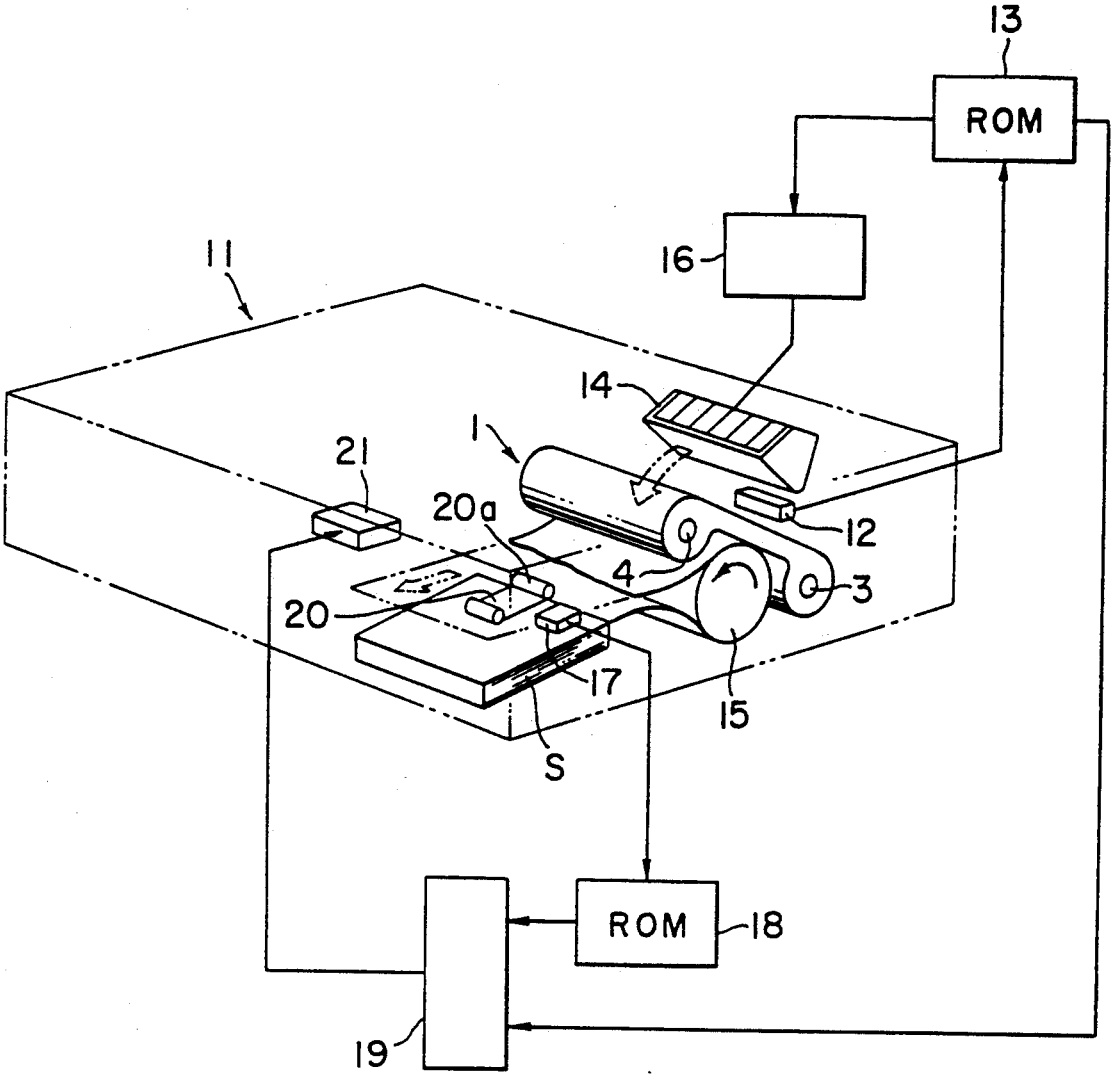
FIG. 2 is a schematic perspective view showing the principle of operation of a printer for carrying out the method according to the present invention.

The following is a description of the usage of the thermal transfer printing film cassette 1 having the organization described above. FIG. 2 shows a printer 11 in which the thermal transfer printing film cassette 1 is to be used. The printer 11 is provided with reflection sensors 12 corresponding to the mark positions 7 through 10. When the thermal transfer printing film cassette 1 is mounted to the printer 11, these sensors 12 send signals to a ROM 13 in which various types of operational conditions corresponding to the ink characteristics and usage have been stored beforehand, so that it is possible to change and set the conditions for the output energy to a thermal head 14 of the printer. The thermal head 14 is moved to and away from its operative position by means of an actuator 16. After this, when the printer 11 is started, the take-up roll 4 is driven and the thermal transfer printing film 6 is fed between the thermal head 14 and a platen roller 15 in the direction indicated by the arrow in FIGS. 1 and 3, and image recording in accordance with the thus set usage and ink characteristic of the thermal transfer printing film 6 is performed by the thermal head 14 onto sheets S fed one by one by a conveying belt 20 from a stack of the sheets, in a manner known in the art. A drive roller 20*a* for the belt 20 is rotated by a drive source 21. Each of the sheets S may have at an appropriate position thereon a sheet mark indicating the usage (such as standard use or use for OHP). Upon each sheet S arriving at an appropriate position in the printer, the sheet mark is detected by a sensor 17. When the sheet mark is detected, the sensor 17 reads the information recorded in the mark and sends a signal corresponding to the information to a ROM 18. The signal from the ROM 18 is compared with a signal from the ROM 13 in a comparator 19, and only when the usage of the sheet detected by the sensor 17 corresponds to the usage of the transfer printing film 6 indicated by the mark on the cassette 1, a signal is supplied to the drive source 21 to feed the sheets, thereby to operate the printer 1 to carry out the printing.

In the cassette described above, the color of the cassette case 2 is black, and the seals of PET film to which aluminum has been vapor deposited are affixed at the mark positions. But the seals may be ones wherein patterns are formed by performing UV printing or the like using black ink onto a PET film that has had aluminum vapor deposited thereon. In this case, it is not necessary for the outer surface of the cassette case 2 to be specifically black. In the case where the outer surface of the cassette case 2 is black, hot stamping or some other printing method can be used to directly apply a pattern as reflective marks to the outer surface of the cassette case 2.

In the case where it is thought that the PET film seal with aluminum vapor deposition may fall off or exert an adverse influence to the base inside the printer, then a PET film seal to which non-conductive aluminum has been vapor deposited, can be used.

The thermal transfer printing film cassette described above has on its outer surface reflective mark that indicate the usage and the ink characteristic of a thermal transfer printing film so that when the cassette is mounted in a printer, reflection sensors inside the printer read the reflective marks and use the information as the basis for automatically setting the printer operation conditions so that there are no errors in the usage conditions even if there is a plural number of cassette types.

The sheets S was described above as having sheet marks indicating the usage. However, the sheet marks may indicate ink characteristics adapted to the sheets. In this case, only when the ink characteristics indicated by the sheet marks correspond to the ink characteristics of the transfer printing film 6 indicated by the mark on the cassette 1, the printer 11 is operated.

What is claimed is:

1. A method of carrying out a thermal transfer printing by using a thermal transfer printer having a thermal head, comprising the steps of:

providing a cassette case housing a thermal transfer printing film and having an outer surface provided with a plurality of marking positions;

applying to one of said positions a reflective mark to indicate a usage of said thermal transfer printing film, depending upon a position of the reflective mark;

setting said cassette case into said printer;

feeding into said printer sheets one by one from a stack of the sheets each having thereon a sheet mark indicating a usage of each of said sheets;

detecting said reflective mark and said sheet mark on each of said sheets; and operating said printer to transfer ink on said thermal transfer printing film onto each of said sheets in accordance with images produced by said thermal head, only when the reflective mark on said cassette case and the sheet mark on each of said sheets indicate identical usages.

2. A method of carrying out a thermal transfer printing by using a thermal transfer printer having a thermal head, comprising the steps of:

providing a cassette case housing a thermal transfer printing film and having an outer surface provided with a plurality of marking positions;

applying to one of said positions a reflective mark to indicate an ink characteristic of said thermal transfer printing film, depending upon a position of the reflective mark;

setting said cassette case into said printer;

feeding into said printer sheets one by one from a stack of the sheets each having thereon a sheet mark indicating an ink characteristic of each of said sheets;

detecting said reflective mark and said sheet mark on each of said sheets; and operating said printer to transfer ink on said thermal transfer printing film onto each of said sheets in accordance with images produced by said thermal head, only when the reflective mark on said cassette case and the ink mark on each of said sheets indicate identical ink characteristics.

* * * * *